US006796552B2

(12) United States Patent
Cote et al.

(10) Patent No.: US 6,796,552 B2
(45) Date of Patent: Sep. 28, 2004

(54) SIGNATURE DELIVERY DEVICE AND METHOD

(75) Inventors: Kevin Lauren Cote, Durham, NH (US); Roland Thomas Palmatier, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/245,027

(22) Filed: Sep. 17, 2002

(65) Prior Publication Data

US 2004/0051226 A1 Mar. 18, 2004

(51) Int. Cl.[7] ..... B65H 39/02
(52) U.S. Cl. ..... 270/52.17; 270/52.14
(58) Field of Search ..... 270/52.17, 52.14, 270/52.09, 39.01, 39.02, 39.04–39.09; 271/302, 303

(56) References Cited

U.S. PATENT DOCUMENTS

| | | | | |
|---|---|---|---|---|
| 4,373,713 A | | 2/1983 | Loebach | 271/303 |
| 4,534,643 A | * | 8/1985 | Watanabe | 399/403 |
| 4,577,789 A | | 3/1986 | Hofmann et al. | 225/100 |
| 4,824,426 A | * | 4/1989 | DuFresne | 493/346 |
| 4,948,112 A | | 8/1990 | Sato et al. | 270/60 |
| 5,112,041 A | * | 5/1992 | Honegger | 271/286 |
| 5,172,908 A | * | 12/1992 | Steinhilber | 271/288 |
| 5,607,146 A | | 3/1997 | Novick et al. | 270/42 |
| 5,615,878 A | | 4/1997 | Belanger et al. | 271/302 |

FOREIGN PATENT DOCUMENTS

| | | |
|---|---|---|
| DE | 4031587 | 11/1991 |
| GB | 1456648 | 11/1976 |

* cited by examiner

*Primary Examiner*—Anthony H. Nguyen
(74) *Attorney, Agent, or Firm*—Davidson, Davidson & Kappel, LLC

(57) ABSTRACT

A signature transport device has a first transport section for transporting a first signature having a first lead edge and a first trail edge, and for transporting a following second signature having a second lead edge and a second trail edge. The first transport section has a signature exit and defines a transport plane; and a second transport section transports the first and second signatures so that the second lead edge is offset from the transport plane and so that the second lead edge and the first trail edge are separated in a direction perpendicular to the transport plane.

15 Claims, 3 Drawing Sheets

SIGNATURE DELIVERY DEVICE AND METHOD

BACKGROUND OF THE INVENTION

The present invention relates generally to printing presses and more particularly to a signature delivery device for transporting printed products.

In order to singularize or collate signatures from a continuous web of material, the lead and trail edges of consecutive signatures must be separated. A conventional solution to this problem has been to accelerate signatures after they have been cut from the web so as to create a head-to-tail space in the direction of travel of the signatures. However, acceleration can cause marking or transport problems for the signatures.

U.S. Pat. No. 4,577,789 discloses a device for severing sets of endless forms or the like, in which the sets have three layers separated by separator plates or strips after the sets are severed. The layers can thus be separated.

U.K. Patent No. 1 456 648 discloses an apparatus for handling a web of material in which the web is transversely cut to divide the web into successive stacks of superposed sheets. A system conveys the stacks past a succession of devices so that the end sheet of each stack is conveyed to a receptacle for receiving the particular sheet of each stack.

German Patent Application No. 40 31 587 discloses a collator for collecting signatures having a first transport device having a plurality of signature receptacles open to the outside for receiving signatures. A second transport device has plurality of devices with a rear surface to push a plurality of the signatures off the first transport device onto a conveyor belt, so that blocks are formed. To alter the number of signatures that form a block, the angle of the lower section of the first transport device can be varied by moving roll thus minimizing the vertical spacing of the signatures and increasing the number of signatures pushed off by a single rear surface.

SUMMARY OF THE INVENTION

An object of the present invention is to provide for improved signature separation and transport.

The present invention provides a signature transport device comprising: a first transport section for transporting a first signature having a first lead edge and a first trail edge, and for transporting a following second signature having a second lead edge and a second trail edge, the first transport section having a signature exit and defining a transport plane; and a second transport section transporting the first and second signatures so that the second lead edge is offset from the transport plane and so that the second lead edge and the first trail edge are separated in a direction perpendicular to the transport plane.

By creating a separation between the lead and trail edge of consecutive signatures, acceleration of the signatures in the direction of travel can be eliminated. Slipping of the signature relative to the transport device can be avoided, so that marking can be reduced and positional accuracy assured.

Preferably, the first transport section includes a set of tapes.

Preferably, the second transport system includes a first belt and a second belt, the first belt having plurality of first wedge regions having a length greater than the signature length, and the second belt having a plurality of second wedge regions interacting with the first wedge regions to separate the second lead edge from the first trail edge.

The first trail edge may be offset from the transport plane by the same amount as the second lead edge, so that the transport plane defines a centerline for the second transport section. The signatures thus are angled with respect to the centerline.

The first and second belts preferably have a straight transport section.

The signature transport device may further include a collating conveyor with a plurality of pockets. The second transport section preferably is oriented vertically so that the signatures in the second transport section drop into the pockets of the conveyor. Preferably, the pocket angle is the same as that of the angle of the signatures in the second transport section.

The direct interface of the second transport section on the collator eliminates the need for storing the signatures and subsequently delivering them from storage for collation.

The present invention also provides a collator having a plurality of the signature transport devices and a collating conveyor.

The present invention also provides a printing press having a folder for cutting a web of printed material into signatures, and the signature transport device.

The present invention also provides a method for transporting signatures through a transport device comprising transporting a first signature in a signature transport plane of a first transport section of the transport device; transporting a second signature following the first signature in the signature transport plane; and moving a lead edge of the second signature with respect to a trail edge of the second signature in a direction perpendicular to the signature transport plane on a second transport section of the transport device.

As used herein, a signature includes a plurality of sheets or a single sheet.

BRIEF DESCRIPTION OF THE DRAWINGS

The following figures show a preferred embodiment of the present invention in which.

DETAILED DESCRIPTION OF A PREFERRED EMBODIMENT

Figure 1:
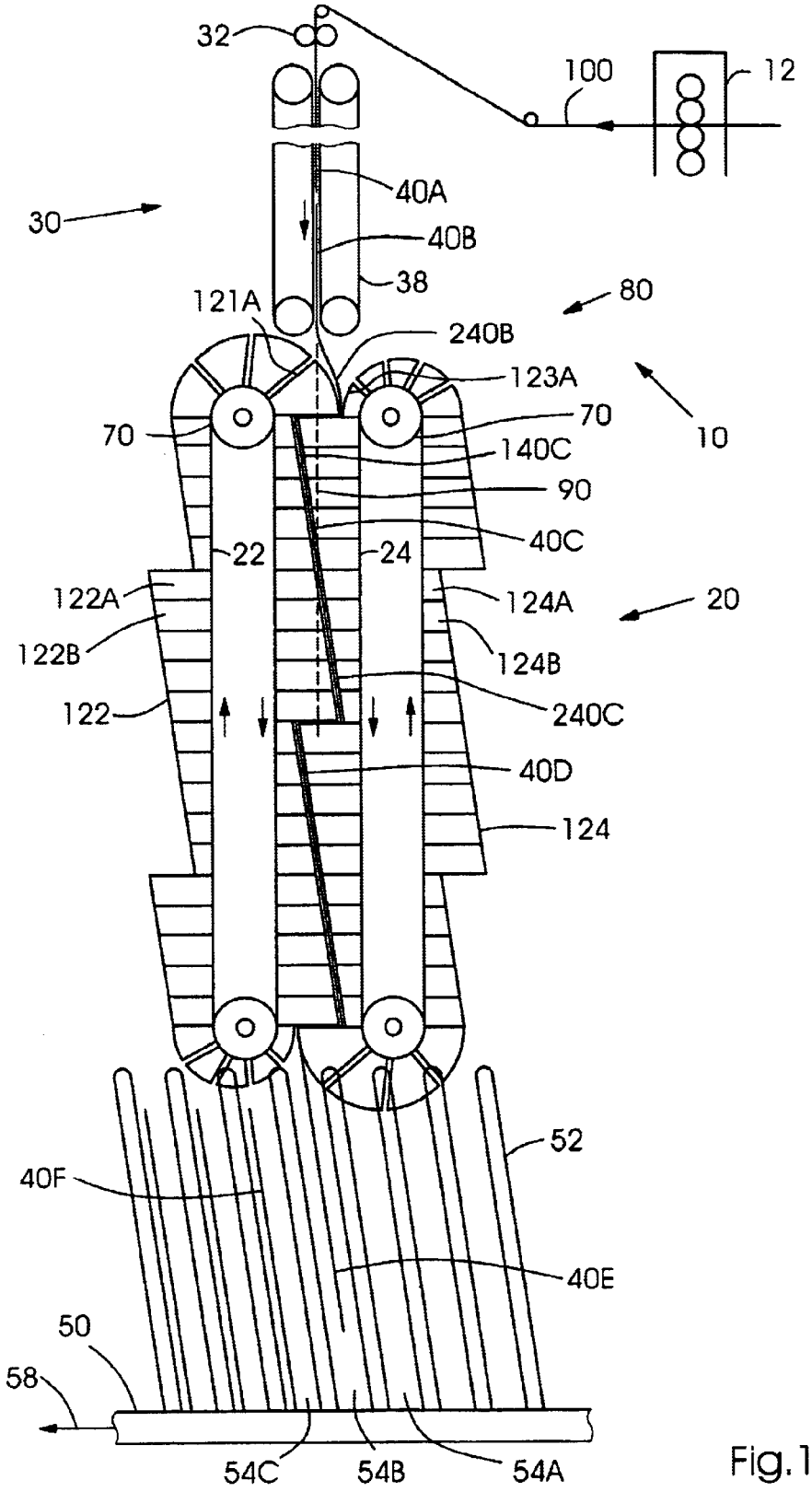
FIG. 1 shows a schematic side view of a preferred exemplary embodiment of the printing press of the present invention with a signature transport device.

FIG. 1 shows a schematic side view of a preferred exemplary embodiment of a printing press 10 of the present invention with a signature transport device 80. A print unit 12 print a web 100 which enters a folder section 30 having a cutting device 32 for cutting the web 100 into signatures 40A, 40B, 40C, 40D, 40E, 40F. The signatures first pass from cutting device 32 to a tape system or first transport section 38 of signature transport device 80.

Once exiting the tape system 38, the signatures enter a separating belt system or second transport section 20 of signature transport device 80. Belt system 20 includes a first belt 22 having wedge sections 122 and a second belt having wedge sections 124. Each wedge section 122 and 124 preferably has a plurality of segments 122A, 122B, etc. and 124A, 124B, etc., respectively. The segments have angled edges so that when the segments are together, an angled face of the wedge sections 122, 124 results. The belts 122, 124 may be driven by rollers 70.

The wedge sections 122, 124 of the belts 22, 24 interact so that a longer wedge segment on one belt interacts with a shorter wedge segment on the other belt, as shown by wedge segment 121A interacting with wedge segment 123A. A lead edge 240B of signature 20B is thus forced to the right of a centerline 90 as signature 20B enters separating belt system 20. Due to the angled nature of the wedges, signature 40C has a lead edge 140C to the right of centerline 90, and a trail edge 240C offset to the left of centerline 90.

Once the signature 40B is gripped between belts 22, 24, the belts 22, 24 travel through a straight section where the velocities of the two belts 22, 24 are equal.

The lead edge 240B is thus offset from trail edge 140C and permits a clean interface with an inline collating conveyor 50 traveling in a direction 58. The conveyor 50 has fingers 52 forming pockets 54A, 54B, 54C etc. As the belts 22, 24 pass over their lower rollers, the signatures drop into the pockets. The pockets 54A, 54B, 54C etc preferably are angled with respect to centerline 90 at a similar angle to the wedge angle.

Figure 2:
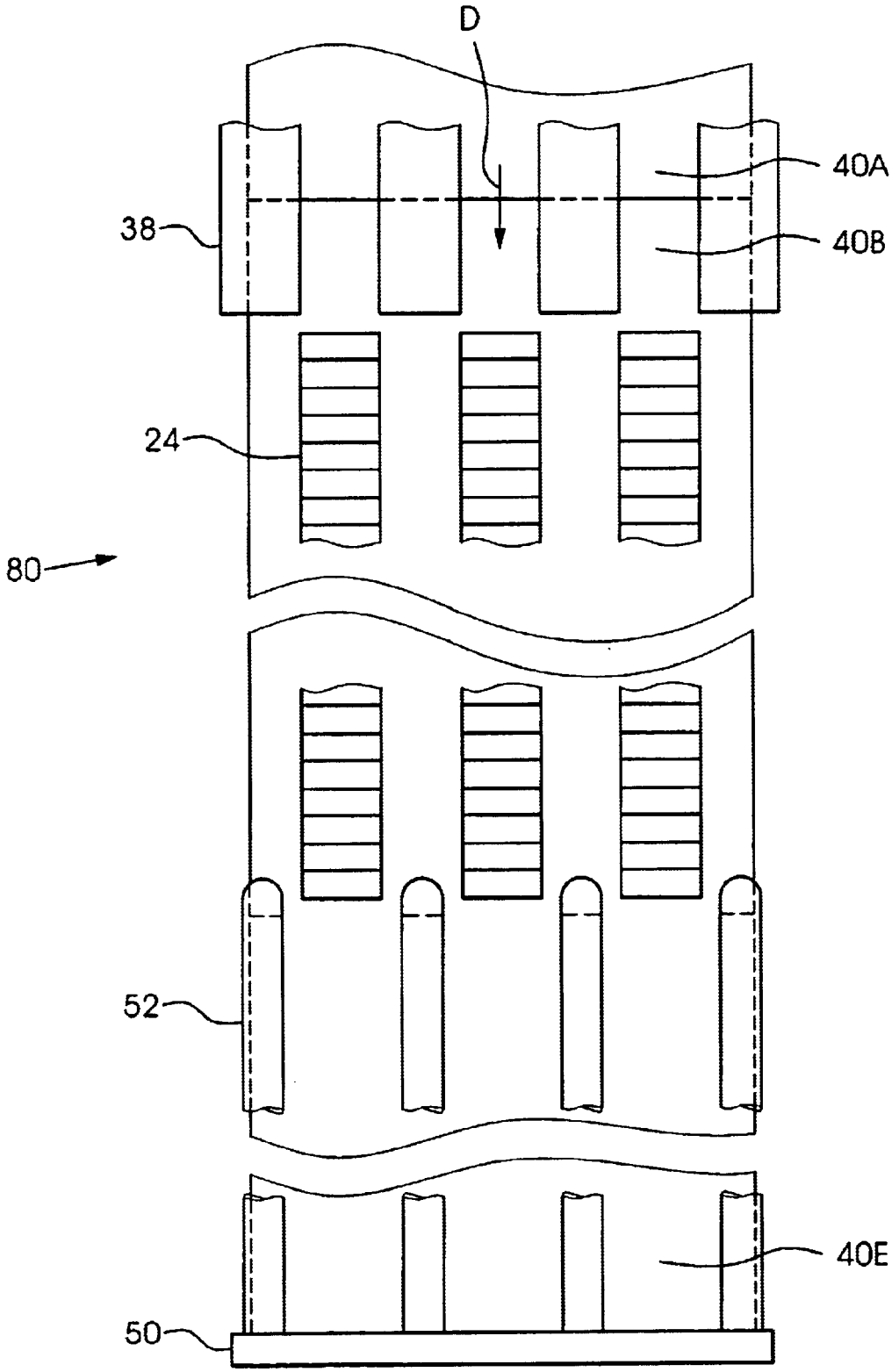
FIG. 2 shows a front view of the embodiment of FIG. 1.

FIG. 2 shows a schematic end view of the signature transport device 80 with the signature 40E reaching the bottom of conveyor 50. The signatures travel in direction D.

Figure 3:
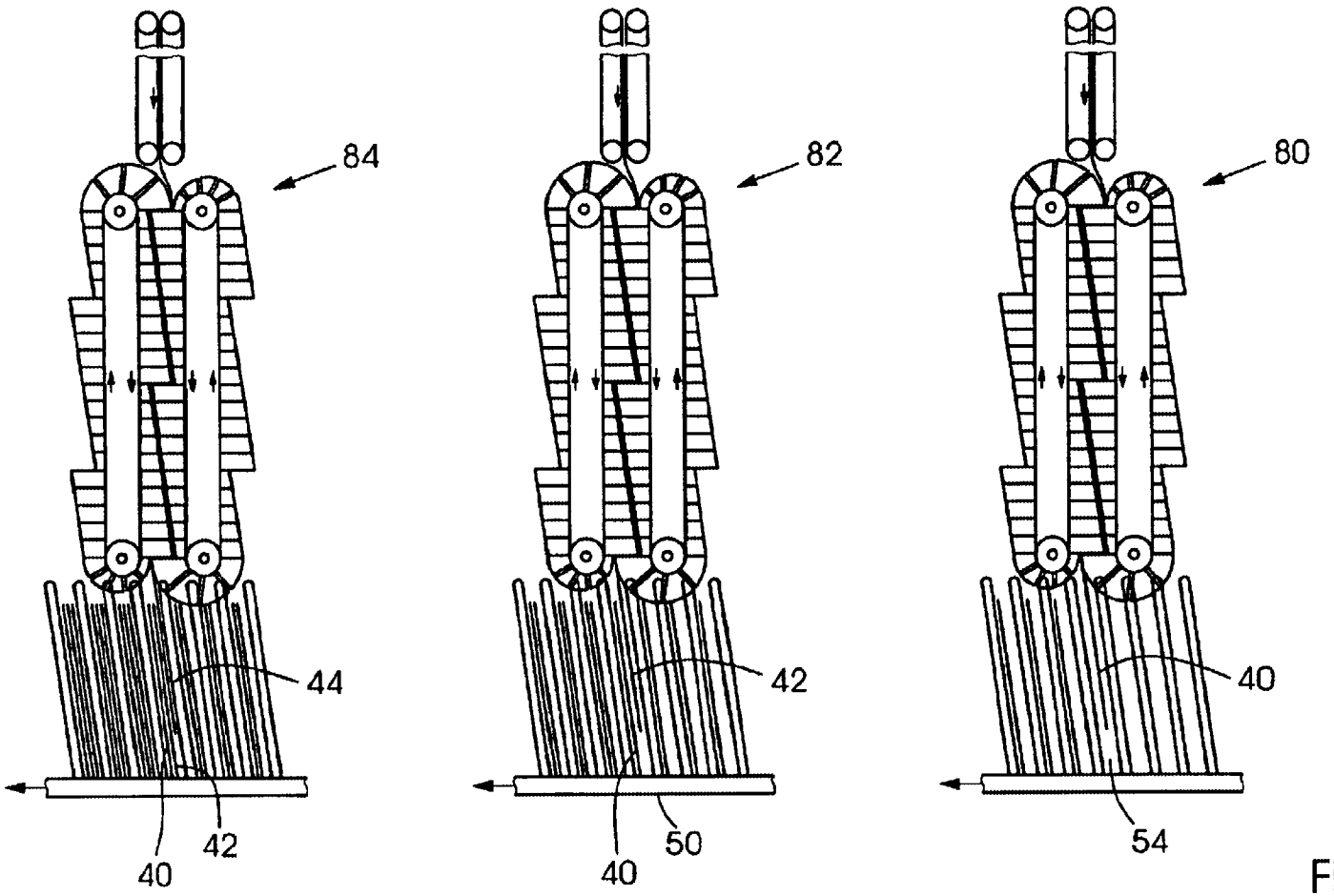
FIG. 3 shows three of the signature devices provided to form a collator of the present invention.

FIG. 3 shows a collator having three signature transport devices 80, 82, 84. Transport device 80 delivers first signatures 40 into pockets 54 of conveyor 50, second transport device 82 delivers second signatures 42 into pockets 54 that already contain first signatures 40, and third transport device 84 delivers third signatures 44 into pockets 54 that contain first and second signatures 40, 42. Thus a three signature collated book can be formed in each pocket.

An alternate embodiment includes that the two belts are replaced by two opposing circular disks with interacting wedge sections. However, a mismatch in surface velocity between the two disks may be disadvantageous, so that the belt embodiment shown above is preferred.

What is claimed is:

1. A signature transport device comprising:

a first transport section for transporting a first signature having a first lead edge and a first trail edge, and for transporting a following second signature having a second lead edge and a second trail edge, the first transport section having a signature exit and defining a transport plane; and a second transport section transporting the first and second signatures so that the second lead edge is offset from the transport plane and so that the second lead edge and the first trail edge are separated in a direction perpendicular to the transport plane;

wherein the second transport section includes a first belt and a second belt, the first belt having plurality of first wedge regions angles with respect the transport plane, and the second belt having a plurality of second wedge regions interacting with the first wedge regions to separate the second lead edge from the first trail edge.

2. The device as recited in claim 1 wherein the first transport section includes a set of tapes.

3. The device as recited in claim 1 wherein the first belt and the second belt each have a straight section.

4. The device as recited in claim 1 wherein the first trail edge is offset from the transport plane by the same amount as the second lead edge, so that the transport plane defines a centerline for the second transport section.

5. The device as recited in claim 1 further including a collating conveyor with a plurality of pockets.

6. The device as recited in claim 5 wherein the second transport section is oriented vertically so that the first and second signatures drop into the pockets of the conveyor upon exiting the second transport section.

7. A signature transport device comprising:

a first transport section for transporting a first signature having a first lead edge and a first trail edge, and for transporting a following second signature having a second lead edge and a second trail edge, the first transport section having a signature exit and defining a transport plane;

a second transport section transporting the first and second signatures so that the second lead edge is offset from the transport plane and so that the second lead edge and the first trail edge are separated in a direction perpendicular to the transport plane; and a conveyor having a plurality of pockets for receiving the signatures from the second transport section, the pockets having a pocket angle being the same as that of an angle of the first and second signatures in the second transport section.

8. The device as recited in claim 1 wherein in the second transport section the first signature travels at an angle to the transport plane.

9. The device as recited in claim 7 wherein the first belt and the second belt each have a straight section.

10. The device as recited in claim 7 wherein the first trail edge is offset from the transport plane by the same amount as the second lead edge, so that the transport plane defines a centerline for the second transport section.

11. The device as recited in claim 7 wherein the second transport section is oriented vertically so that the first and second signatures drop into the pockets of the conveyor upon exiting the second transport section.

12. The device as recited in claim 7 wherein the first transport section includes a set of tapes.

13. A printing press comprising:

a signature transport device comprising a first transport section for transporting a first signature having a first lead edge and a first trail edge, and for transporting a following second signature having a second lead edge and a second trail edge, the first transport section having a signature exit and defining a transport plane; and a second transport section transporting the first and second signatures so that the second lead edge is offset from the transport plane and so that the second lead edge and the first trail edge are separated in a direction perpendicular to the transport plane; the second transport section including a first belt and a second belt, the first belt having plurality of first wedge regions angled with respect the transport plane, and the second belt having a plurality of second wedge regions interacting with the first wedge regions to separate the second lead edge from the first trail edge.

14. The printing press as recited in claim 13 further comprising a printing unit for printing a web of material and a cutting device for cutting the web of material into a plurality of signatures including the first and second signatures.

15. A method for transporting signatures through a transport device comprising:

transporting a first signature in a signature transport plane of a first transport section of the transport device;

transporting a second signature following the first signature in the signature transport plane; and moving a lead edge of the second signature with respect to a trail edge of the second signature in a direction perpendicular to the signature transport plane on a second transport section of the transport device using a belt having a plurality of wedges regions angled with respect to the signature transport plane.

* * * * *